US007584708B1

(12) United States Patent
Viltrakis et al.

(10) Patent No.: US 7,584,708 B1
(45) Date of Patent: Sep. 8, 2009

(54) LOW PROFILE CLAMP FOR EMBROIDERY MACHINE

(76) Inventors: Vytenis J Viltrakis, 1027 Highland Ave., Fort Thomas, KY (US) 41075; Mark Mason, 9185 LeSaint Dr., Fairfield, OH (US) 45104

( * ) Notice: Subject to any disclaimer, the term of this patent is extended or adjusted under 35 U.S.C. 154(b) by 615 days.

(21) Appl. No.: 11/225,430

(22) Filed: Sep. 12, 2005

Related U.S. Application Data

(60) Provisional application No. 60/608,578, filed on Sep. 10, 2004.

(51) Int. Cl.
*D05C 9/04* (2006.01)
*D05B 39/00* (2006.01)

(52) U.S. Cl. ..... 112/103

(58) Field of Classification Search ..... 112/102.5, 112/103, 114, 470.09, 470.14, 311; 38/102.91
See application file for complete search history.

(56) References Cited

U.S. PATENT DOCUMENTS

| | | | | |
|---|---|---|---|---|
| 3,216,383 | A * | 11/1965 | Bono | 112/114 |
| 3,405,670 | A * | 10/1968 | Scholl et al. | 112/470.09 |
| 3,730,116 | A * | 5/1973 | Schramayr | 112/470.14 |
| 5,005,501 | A * | 4/1991 | Kita | 112/102.5 |
| 6,336,416 | B1 * | 1/2002 | French et al. | 112/103 |
| 6,679,190 | B1 * | 1/2004 | French et al. | 112/103 |

* cited by examiner

*Primary Examiner*—Ismael Izaguirre
(74) *Attorney, Agent, or Firm*—King & Schickli, PLLC

(57) ABSTRACT

A low profile clamp for an embroidery machine uses resilient arms that function as a leaf spring to transmit compressive closing forces to secure articles to be embroidered between clamping windows. A roller is moved in an arcuate path to apply bending stresses to clamp arms. The low profile of the clamp allows it to pass between the presser feet and throat plate protecting the presser feet and needles from serious damage if the panagraph moves the body of the clamp in the space between presser feet and throat plate during machine initialization or at any other time.

14 Claims, 11 Drawing Sheets

LOW PROFILE CLAMP FOR EMBROIDERY MACHINE

RELATED APPLICATIONS

This application claims the benefit of U.S. Provisional Patent Application Ser. No. 60/608,578, filed Sep. 10, 2004, the disclosures of which is incorporated herein by reference.

TECHNICAL FIELD

The present invention relates generally to embroidery machines and more specifically to a clamp for securing articles as they are being embroidered. The invention will be disclosed in connection with a low profile clamp that prevents damage to the embroidery machine if the panagraph moves the clamp into the space between the presser feet and the throat plate.

BACKGROUND OF THE INVENTION

In the sewing and embroidery industry, fabric holding clamps are widely used for holding individual work pieces during the embroidery process. While such holding clamps are been used for many years, one problem has persisted. Since it is necessary for a holding clamp to apply a compressive force to hold a article being embroidered between a pair of clamping windows, mechanism used to apply the clamping force have relatively large and bulky. For this reason, the base or body portions prior art holding clamps generally have a relatively thick profile. This profile thickness of the prior art holding clamps has lead to considerable problems, including substantial damage to embroidery machines. The holding clamps generally are moved in an X-Y plane by a panagraph to move the fabric being embroidered along the appropriate path to achieve the desired embroidery. On occasion, the panagraph will move the base or body portion of the fabric holding clamp in the space between the presser feet and the throat plate. This is particularly problematic during initialization of the panagraph controls, as the panagraph my move the clamp throughout the panagraph's entire X-Y movement Unfortunately, this space generally is less than the profile of the clamp, and the thick profile portion of the fabric clamp may be moved into the presser feet and needles, both of which are relatively fragile. As a consequence of this movement, substantial machine damage results, necessitating expensive repairs and downtime.

SUMMARY OF THE INVENTION

It is an object of at least one embodiment of the present invention to obviate one or more of the shortcomings of prior art clamps for embroidery machines.

It is another object of at least one embodiment of the present invention to provide a clamping system that will not damage the embroidery machine if the clamp is moved along a path traversing the space between the presser feet and needles, and the throat plate of an embroidery machine.

Another object of at least one embodiment is to provide an improved clamping mechanism for an embroidery machine that applies a clamping force between clamping windows with a simplified clamping mechanism.

The above objects are provided merely as non-limiting examples, and do not define the present invention or necessarily apply to every aspect thereof. Additional objects, advantages and other novel features of the invention will be set forth in part in the description that follows and will also become apparent to those skilled in the art upon consideration of the teachings of the invention.

To achieve one or more of these objects, one embodiment of the present invention includes an embroidery machine with a base, a throat plate, a head extending outwardly from the base, and a plurality of presser feet extending from the head toward the throat plate. Each of the presser feet are movable relative to the head toward and away from the throat plate and are associated with a needle adapted to pass through an article to be embroidered. Each of the presser feet also are movable between a retracted position in which the presser feet are spaced by a predetermined space from the throat plate and an extended position in which the presser feet are adapted to engage an article to be embroidered. The article to be embroidered is positioned in a sewing location between the presser feet and the throat plate while the needles pass through the article to be embroidered. A first clamping window is provided with a first embroidery opening. A a second clamping window with a second embroidery opening is also provided with the first and second clamping windows being movable between first relative positions in which the second clamping window is spaced from the first clamping window and second relative positions in which the first and second openings are aligned with each other. The first and second clamping windows are cooperatively operative to clamp an article to be embroidered in the sewing location between the presser feet and the throat plate when the clamping windows are in their second relative positions. A clamp is provided for effectuating relative movement between the first and second clamping windows and applying a compressive force between the first and second windows when the clamping windows are in their second relative positions. When in these second positions, the clamping windows securing an article to be embroidered therebetween. The clamp is secured to the panagraph. The panagraph is operative to effectuate two dimensional movement to the clamp and to move an article secured between the clamping windows relative to the needles in two-directional movement perpendicular to the predetermined space between the presser feet and the throat plate. The clamp is dimensioned and configured to pass through the predetermined space between the presser feet and the throat plate so as to prevent damage if the panagraph positions the clamp in the space between the plates and the throat plate.

In one exemplary embodiment, the clamp further includes at least one arm interconnecting with the clamping windows.

In another exemplary embodiment, the at least one arm is formed of resilient material and the clamp utilizes the resilient properties of the at least one arm to apply a compressive force between the clamping wi the at least one arm is rotatably mounted on a first shaft.

According to one exemplary embodiment, the clamp includes an actuator with at least one roller, and the at least one roller is moved along a portion of the arm to apply a bending moment on the arm and to apply a compressive force between the clamping windows.

In another exemplary embodiment, the at least one roller is mounted on a rotatable actuating shaft extending parallel to the first rotatable shaft. The actuating shaft includes a portion that is offset from the rotatable axis of the actuating shaft with the roller being rotatably mounted on the offset portion. With such a configuration, rotation of the actuating shaft results in arcuate movement (i.e., movement in an arc) of the roller.

According to another exemplary embodiment, the at least one arm extends around the first rotatable shaft with a relatively long window interface portion extending on one side the first shaft and interfacing with the clamping windows. A relatively short return portion extends on the opposite side of the shaft. With this configuration, arcuate movement of the at least one roller applies a clamping force to the interface portion by engaging the return portion and applying a bending stress against the return portion. This tends to separate the interface and return portions of the arm.

In another embodiment, the actuating shaft is movable between first and second positions. The first position corresponds to the first relative positions of the clamping windows and the second position corresponds to the second relative positions of the clamping windows.

According to another exemplary embodiment, a spring is provided for urging the actuating shaft toward the first position.

In another exemplary embodiment, an actuator handle is provided for rotating the actuating shaft.

In another exemplary embodiment, the clamp further includes a pair of arms interconnecting with the clamping windows. The arms are mounted on a first shaft and are formed of material having sufficient resiliency so as to permit the arms to act as leaf springs. An actuator with a rotatable actuating shaft is provided extending parallel to the first shaft with an offset portion onto which a pair of rollers are mounted. Thus, rotation of the actuating shaft results in arcuate movement of the roller. The actuating shaft is rotatably movable between first and second positions. The first position corresponds to the first relative positions of the clamping windows and the second position corresponds to the second relative positions of the clamping windows. Each of the arms extends around the first shaft and includes a relatively long window interface portion extending on one side the first shaft and interfacing with the clamping windows. A relatively short return portion extends on the opposite side of the shaft. Thus, arcuate movement of the rollers applies a clamping force to the interface portion of the arms by engaging the return portions and applying a bending stress against the return portions. This also tends to separate the interface and return portions of the arms whereby arcuate movement of the rollers applies a clamping force to the interface portion by engaging the return portion and applying a bending stress against the return portion.

In another exemplary embodiment, a clamp is provided for use in an embroidery machine. The clamp includes a clamp body adapted to secure a first embroidery clamping window. A clamp arm formed of a resilient material and having a window interface for interconnecting with a second embroidery clamping window, is pivotally attached to the clamp body. The clamp arm is adapted to move a second embroidery clamping window relative to the first clamping window. The clamp is further adapted to operatively apply a force against the window interface to urge the second clamping window into compressing relationship to the first clamping window so as to compressingly hold an article to be embroidered between the first and second windows. An actuator is provided for pivotally rotating the clamp arm with respect to the clamp body. The actuator is further operative to apply a bending stress on a portion of the clamp arm remote from the window interface. The resilient properties of the clamp arm operate to apply a compressive force to the window interface in response to the bending stress.

According to another exemplary embodiment, the clamp arm is formed of spring tempered stainless steel.

In another embodiment, the clamp is d dimensioned and configured to pass through a space between presser feet and a throat plate on an embroidery machine so as to prevent damage to the embroidery machine if the clamp is positioned between the presser feet and the throat plate of an embroidery machine.

In another exemplary embodiment, an embroidery machine having a base, a head extending outwardly from the base is provided. The head has a plurality of needles extending therefrom. The needles are movable between a first retracted position and an extended position. A clamping mechanism is provided for holding an article to be embroidered beneath the head. The clamping mechanism includes first and second clamping frames having a first and second embroidery openings respectively. The first and second clamping frames are movable between first relative positions in which the clamping frames are separated and second relative positions in which the clamping frames compressingly engage an article to be embroidered therebetween. The clamping mechanism is dimensioned and configured to fit in the space between the retracted position of the needles and the throat plate.

BRIEF DESCRIPTION OF THE DRAWINGS

The accompanying drawings incorporated in and forming a part of the specification, illustrate several aspects of the invention, and together with the description serves to explain the principles of the invention. In the drawings.

Reference will now be made in detail to exemplary embodiments of the invention, an example of which is illustrated in the accompanying drawings.

DETAILED DESCRIPTION OF EXEMPLARY EMBODIMENTS

Figure 1:
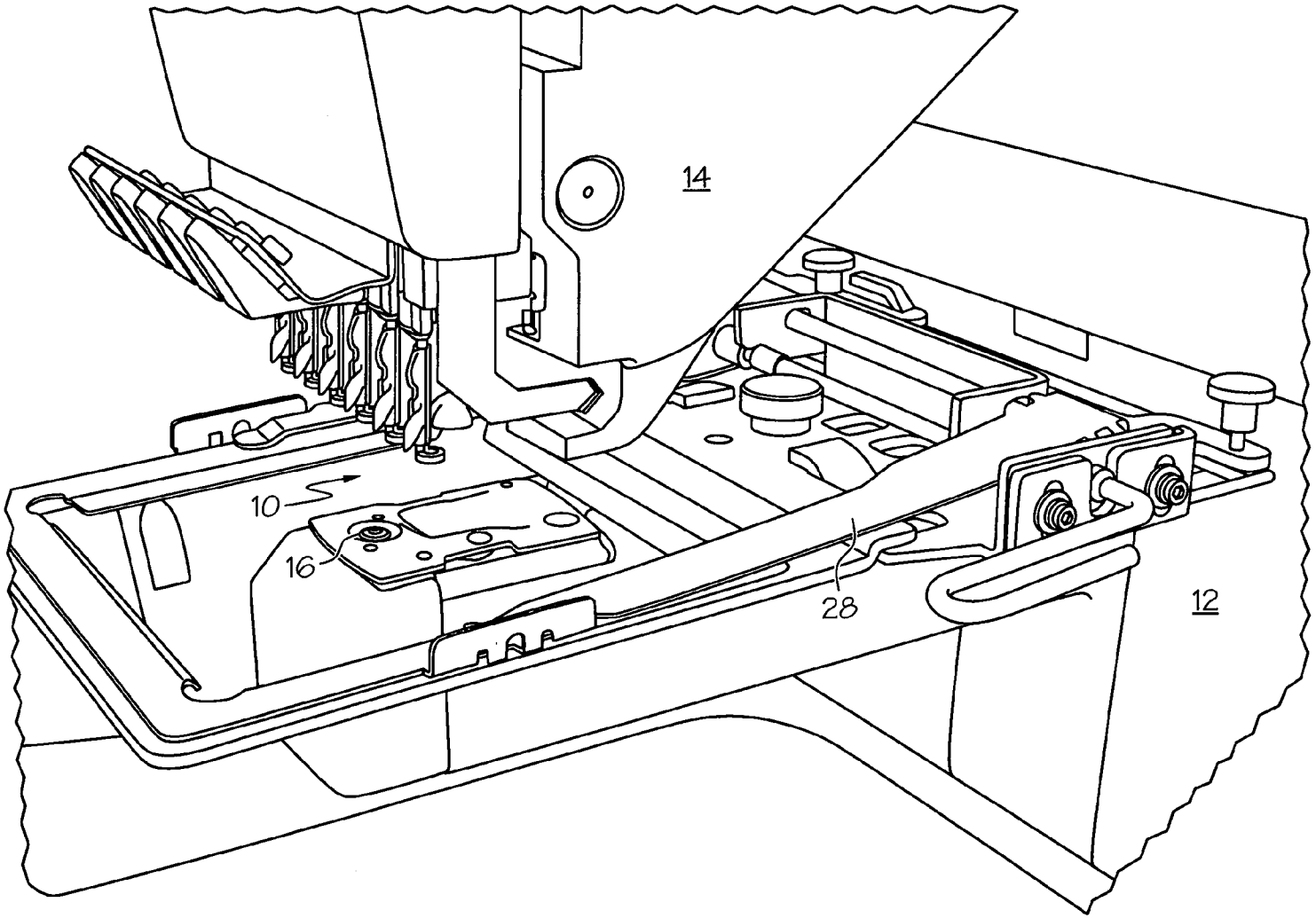
FIG. 1 is a perspective view showing an embroidery machine and clamp constructed according to the principles of the present invention.

Referring now to the drawings, FIG. 1 shows one form of an embroidery machine 10 constructed in accordance with the principles of the present invention. The machine, which is conventional except for the low profile clamp, which is described in detail below, includes a base 12, which supports a head 14 extending outwardly therefrom. A plurality of presser feet, collectively referenced by the numeral 16, extend downwardly from the head 14. As those skilled in the art will readily appreciate, the presser feet are movable from a first retracted position (shown in FIG. 1) to an extended position where they engage an article to be embroidered. Each of the presser feet 16 is associated with a needle 18. The outer end of each of the needles 18 pass though a fabric or other article (not shown in FIG. 1, see FIG. 2) interposed between the presser foot 16 and a throat plate 20. As will be apparent to those skilled in the art, the lower (in the illustrated orientation) end of the needles interact with a bobbin or other type of hooking mechanism (not shown) positioned beneath the article being embroidered. As also will readily appreciated by those in the art, the bobbin or other mechanism (not shown) grabs a loop of the thread carried by the needles and wraps it around either another piece of thread or another loop in the same piece of thread, as is conventional in sewing machines.

Figure 2:
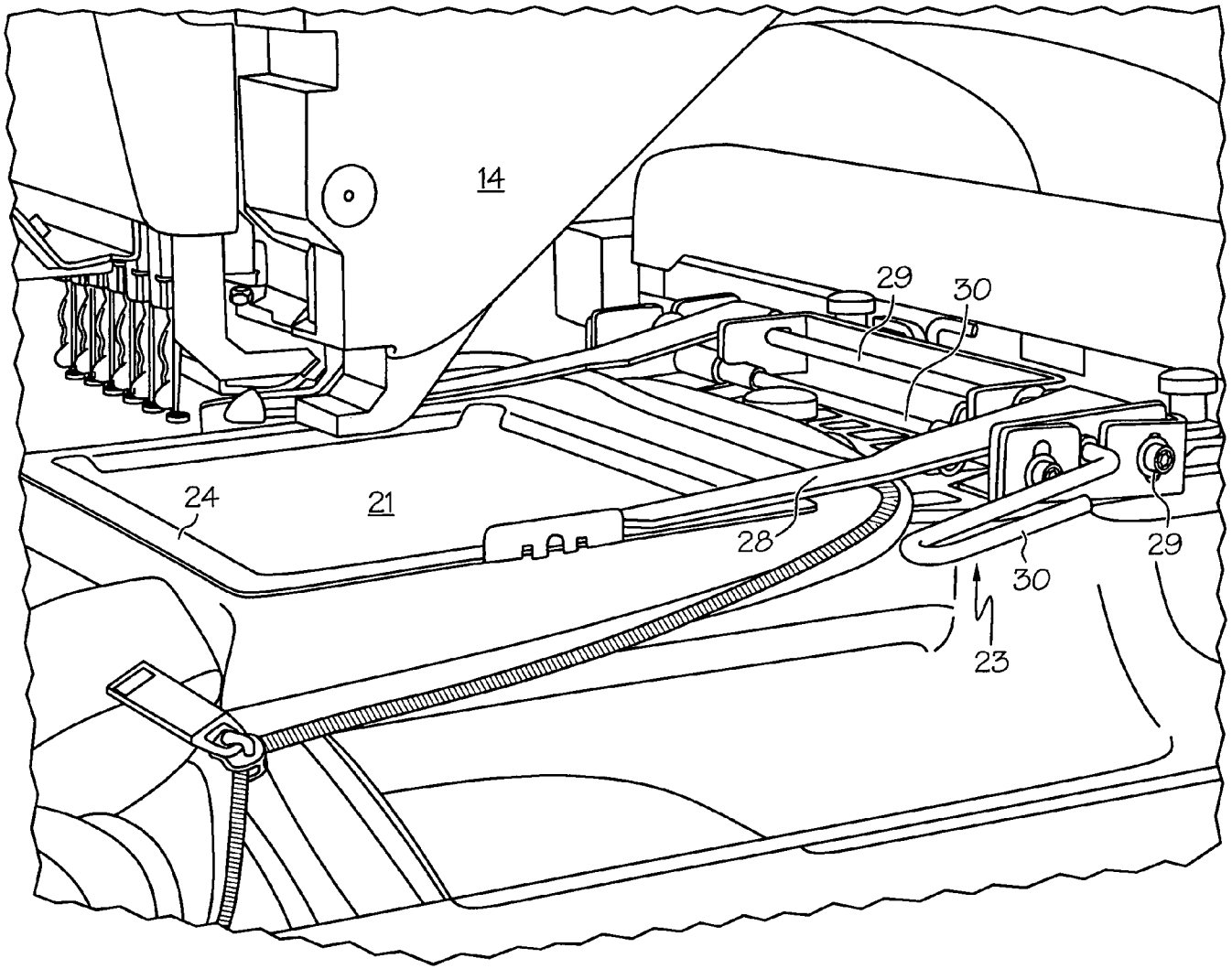
FIG. 2 is a perspective view of the embroidery illustrated in FIG. 1 with an article to be embroidered clamped between the two clamping windows.
Figure 3:
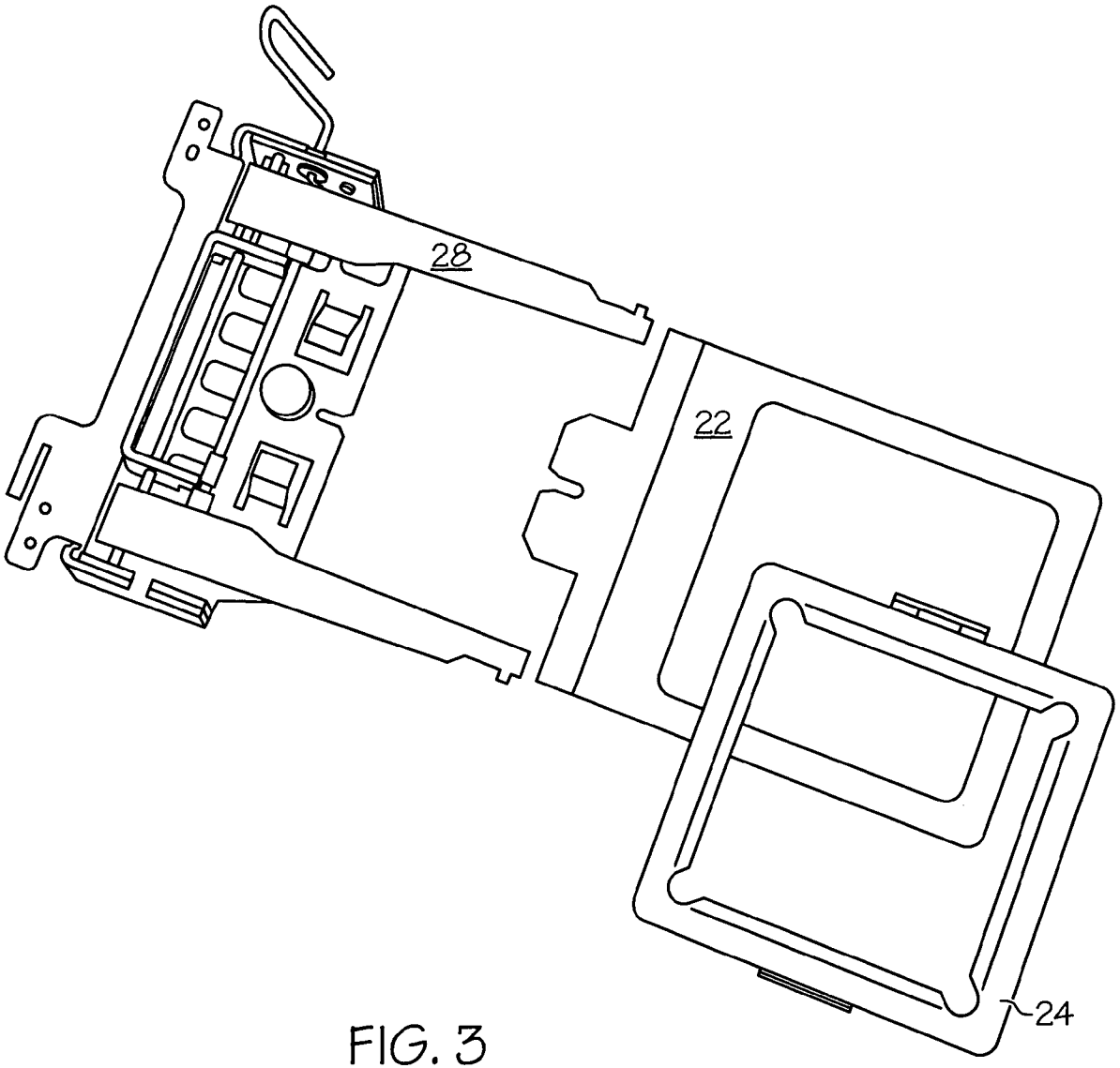
FIG. 3 is a perspective view showing the clamp and embroidery windows of FIG. 1 partially unassembled.
Figure 4:
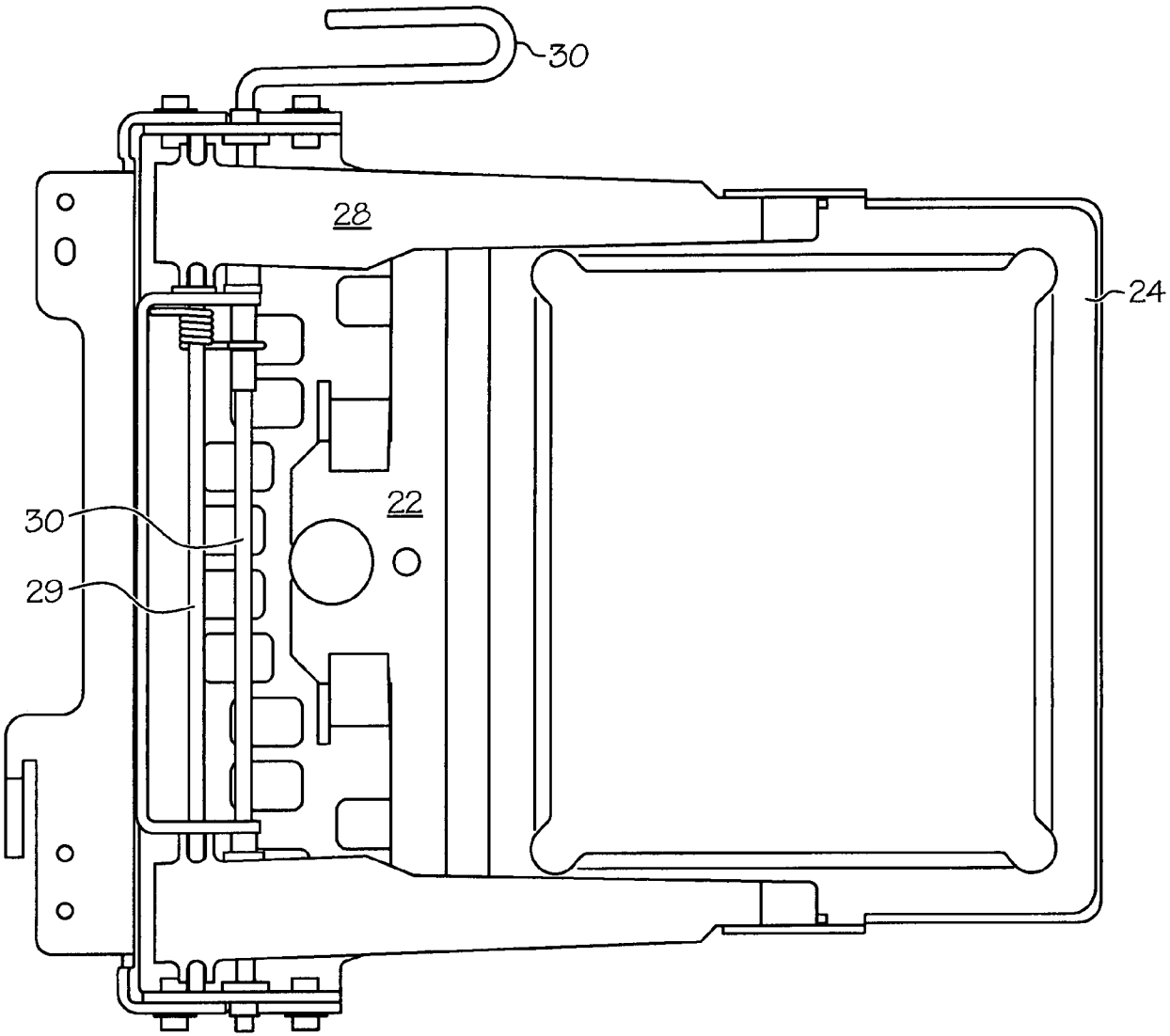
FIG. 4 is a plan view of the clamp and embroidery windows utilized on the embroidery machine illustrated in FIG. 1.

As best seen in FIG. 2, a fabric 21 or other article to be embroidered is secured by a clamping mechanism, generally designed by the numeral 23, constructed in accordance with the principles of the present invention. As more easily appreciated from viewing FIGS. 1 and 2 in conjunction with FIG. 3, this clamping mechanism 23 is located beneath the presser feet 16 and includes a pair of clamping windows, a lower clamping window 22 and an upper clamping window 24. The lower clamping window 22 is obscured by the fabric 21 in FIG. 2 and partially obscured by the upper clamping window 24 in FIG. 1, but is clearly shown in FIGS. 3–5. In the exemplary embodiment illustrated, each of the clamping windows 22, 24 have centrally disposed openings of generally rectangular configuration. It may be desirable to vary the size and configuration of the central openings in the clamping windows. Toward that end, the clamping windows 22, 24 preferably are interchangeably fitted to a clamp body 26 so that different sized and shaped clamping windows can be utilized with the same clamp body 26, depending upon the article to be embroidered. Depending upon the article to be embroidered, the window openings may be circular, oval or any other configuration.

Figure 5:
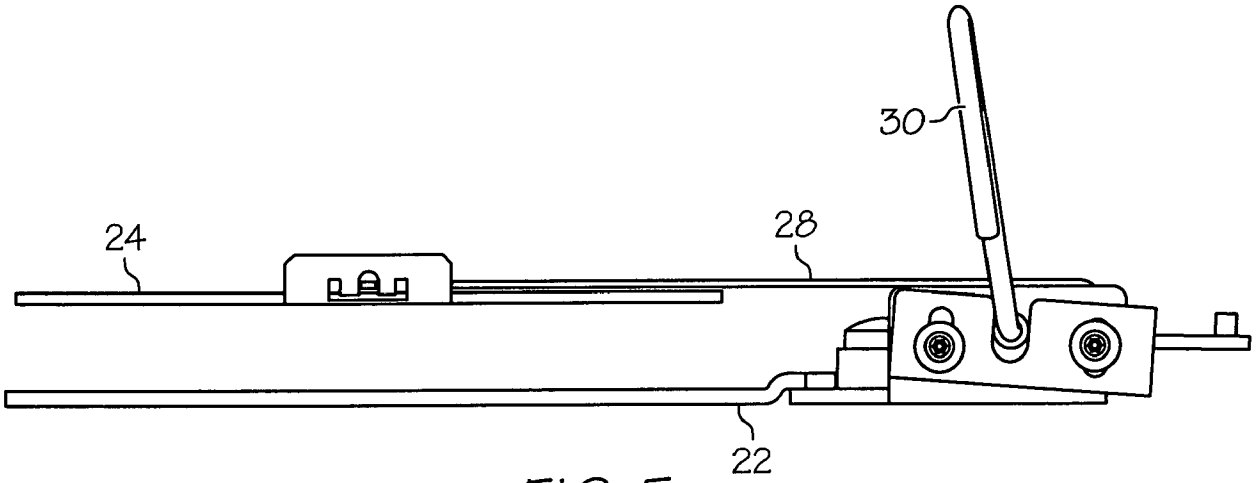
FIG. 5 is a side view of the clamp shown in FIG. 6 as it is assembled and in a clamp open position.
Figure 6:
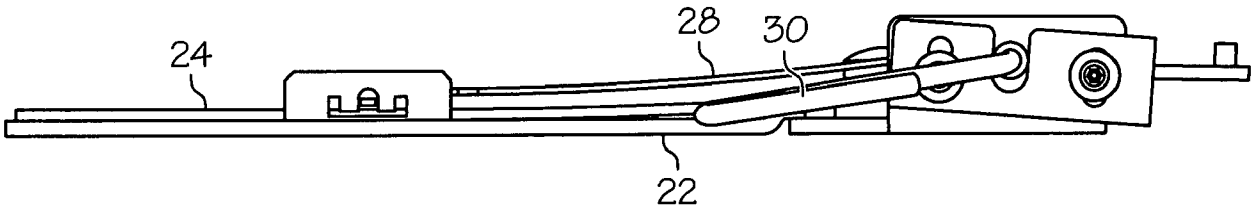
FIG. 6 is a side view of the clamp of FIG. 7 showing the clamp in a clamp closed position.

The clamp body 26 moves the clamping windows 22, 24 between a first clamp open position and a second clamp closed position, as shown in FIGS. 5 and 6 respectively. In the second closed position, also shown in FIG. 1, the centrally disposed openings of the windows 22 and 24 are aligned with each other and windows 22, 24 are compressingly urged against each other to secure an interposed article, such as fabric 21 shown in FIG. 2 to be embroidered.

Figure 7:
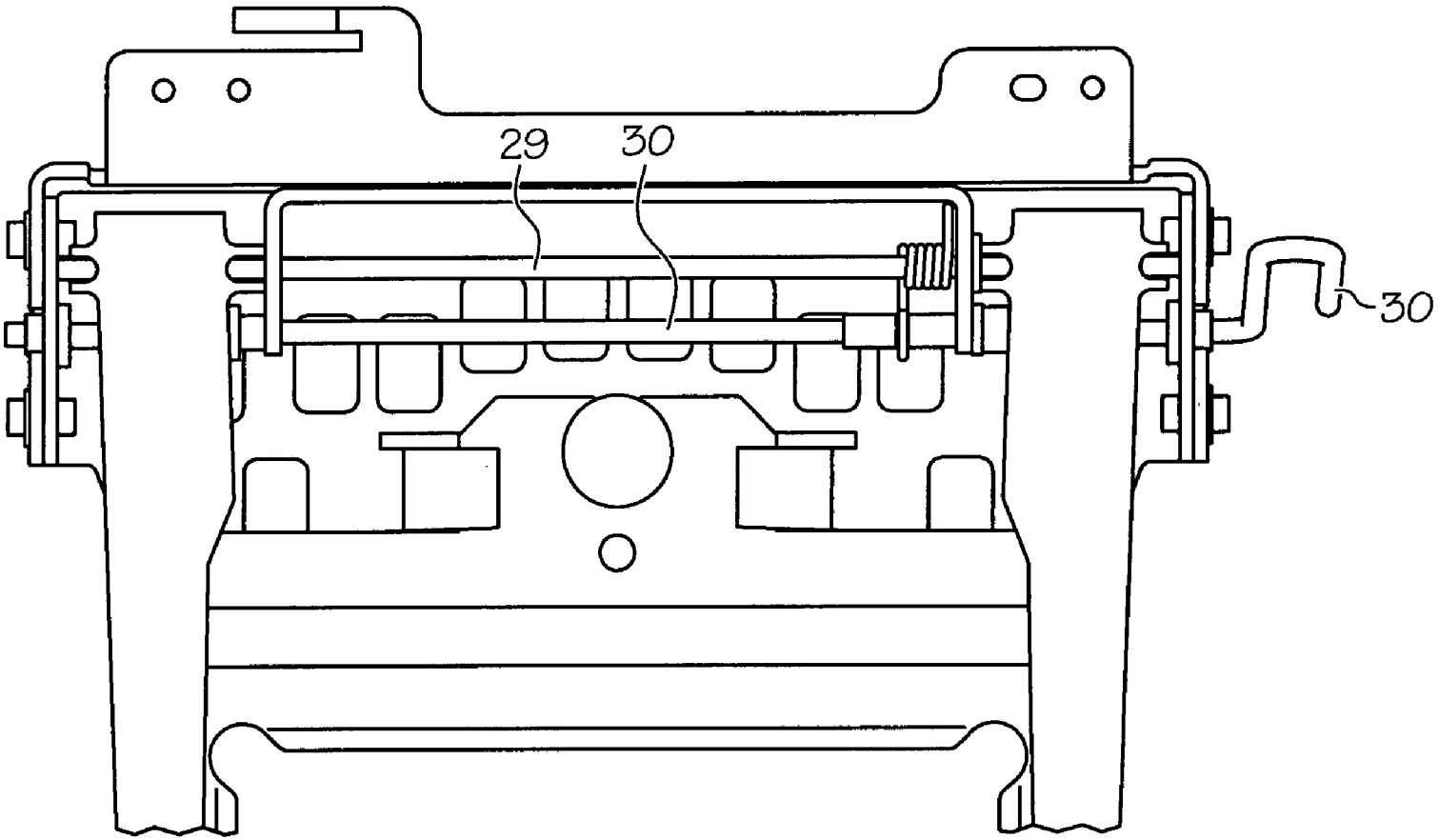
FIG. 7 is a plan view of the clamp of FIG. 1 with the clamping windows removed depicting the clamp mechanism in the clamp open position of FIG. 5.
Figure 9:
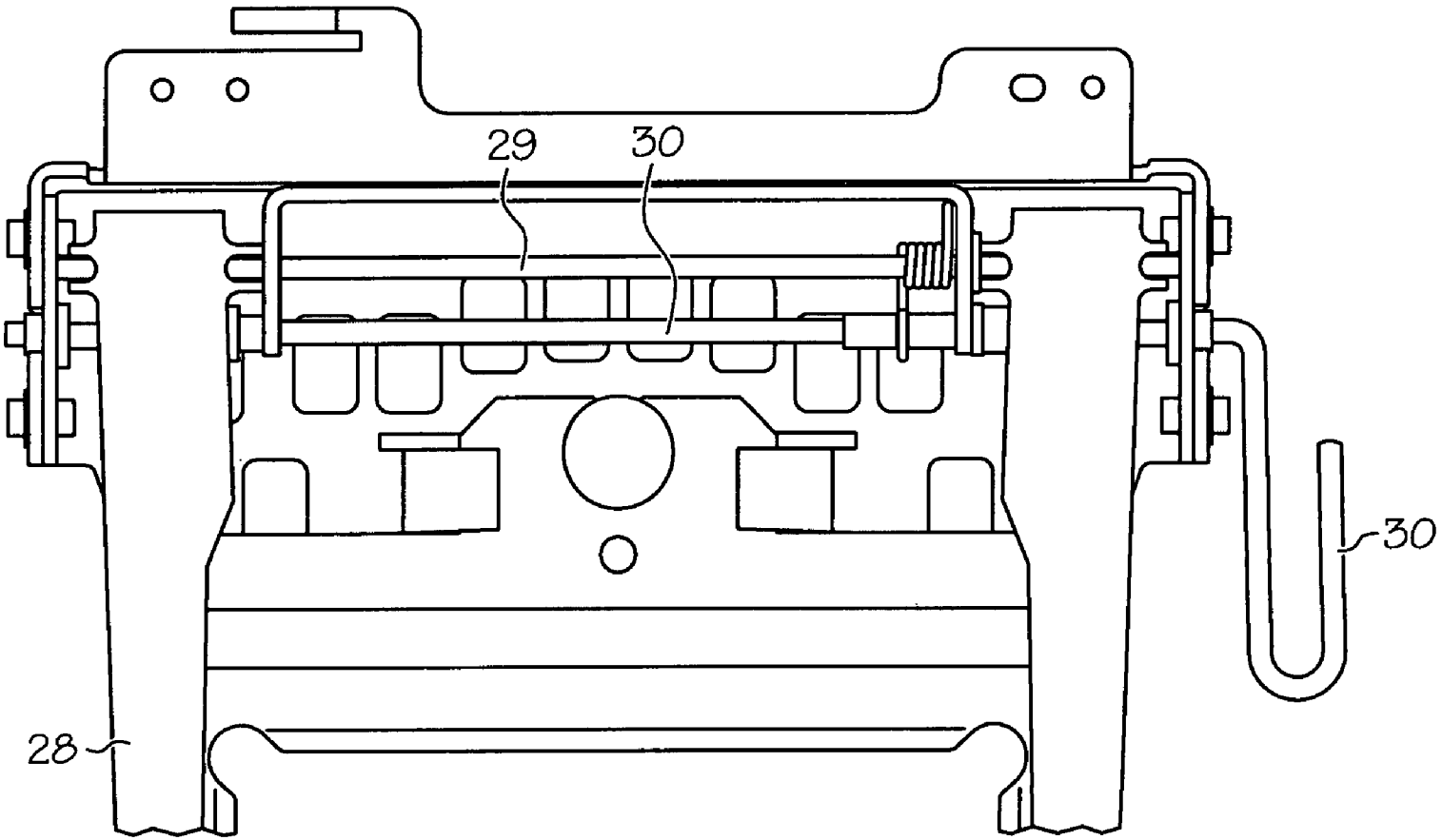
FIG. 9 is a plan view similar to FIG. 7, but depicting the clamp mechanism in the clamp closed position of FIG. 6.

In the exemplary embodiment illustrated, relative movement of the windows 22, 24 is achieved through the agency of one or more clamp arms 28. The clamp arms 28 preferable are formed of a resilient material, such as spring tempered stainless steel. As most clearly illustrated in FIGS. 7 and 9, the clamp arms 28 are pivotally secured to the body portion of the clamp along a first rotatable shaft or rod 29, with each clamp arm including a window interface 31 that pivotally attaches the clamp arm to the upper window 24. An actuator 30 effectuates rotational movement of the clamp arm relative to the clamp base.

Figure 8:
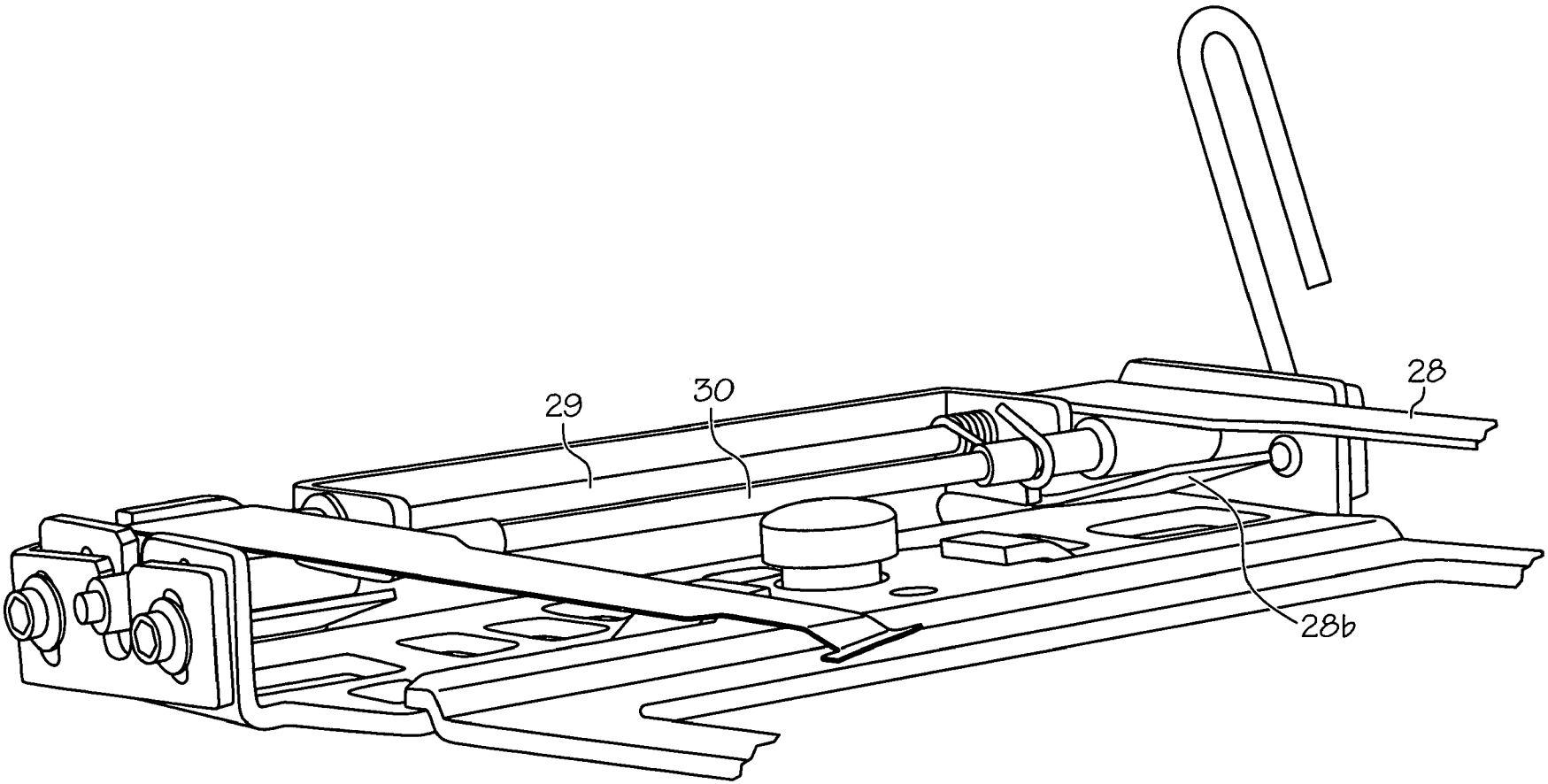
FIG. 8 is a perspective view of the clamp mechanism of FIG. 7 showing one of the rollers in the clamp open position.
Figure 10:
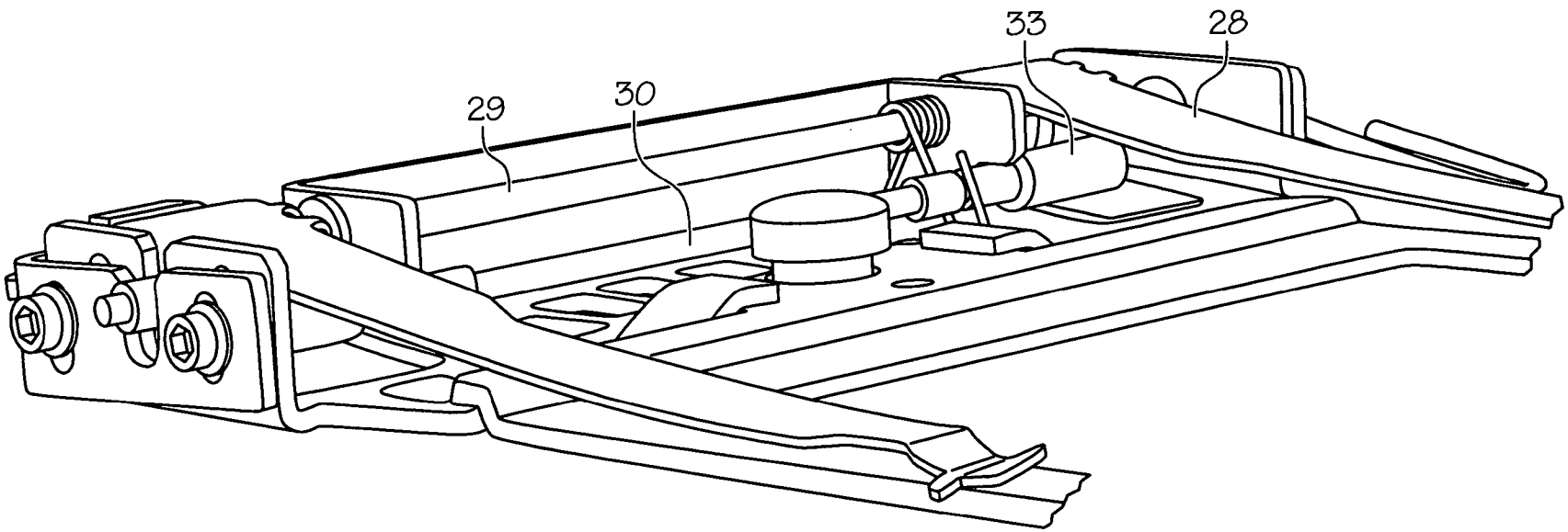
FIG. 10 is a perspective view of the clamp mechanism of FIG. 9 showing one of the rollers in the clamp closed position.

As perhaps best seen in FIG. 8, the illustrated clamp arms 28 extend around the rod 29. Each arm 28 includes a relatively long window interface portion 28*a* on one side (as illustrated, the top side) of the rotatable shaft 29 and a relatively short (relative to the window interface portion) return portion 28*b* on the opposite side. The actuator 30 includes a rotable shaft 30*a* that extends parallel to the first rotatable shaft 29. The actuator shaft includes an offset portion 30*b*. Rollers 33 are rotatably mounted on this offset portion 30*b* of actuator shaft 30. When the actuator 30 is rotated and moved from the clamp open position of FIG. 5 to the clamp closed position of FIG. 6, the rollers 33 move along an arcuate path in contact with the return arm portion 28*b*. The positions of the rollers relative to the arm in the clamp open position and clamp closed position are shown in FIGS. 8 and 10 respectively. This movement of the rollers 33 applies a bending stress against the return portion of the clamp arms 28*a*, and tends to separate the interface 28*a* and return portions 28*b* of the arm 28. The resilient properties of the clamp arms are then operative to apply a compressive force to the window interfaces in response to the bending stress applied to the return portions 28*a* of the clamp arms 28. A spring 35 mounted around the first shaft 29 with its opposite ends secured to the clamp body 36 and the offset portion 30*b* of actuating shaft 30. This spring 35 urges the actuating shaft 30 toward the clamp open position. The clamp arms 28 thus operate both as arms to effectuate relative movement of the windows and as leaf springs to apply a compressive force between the windows to secure an article therebetween.

Figure 11:
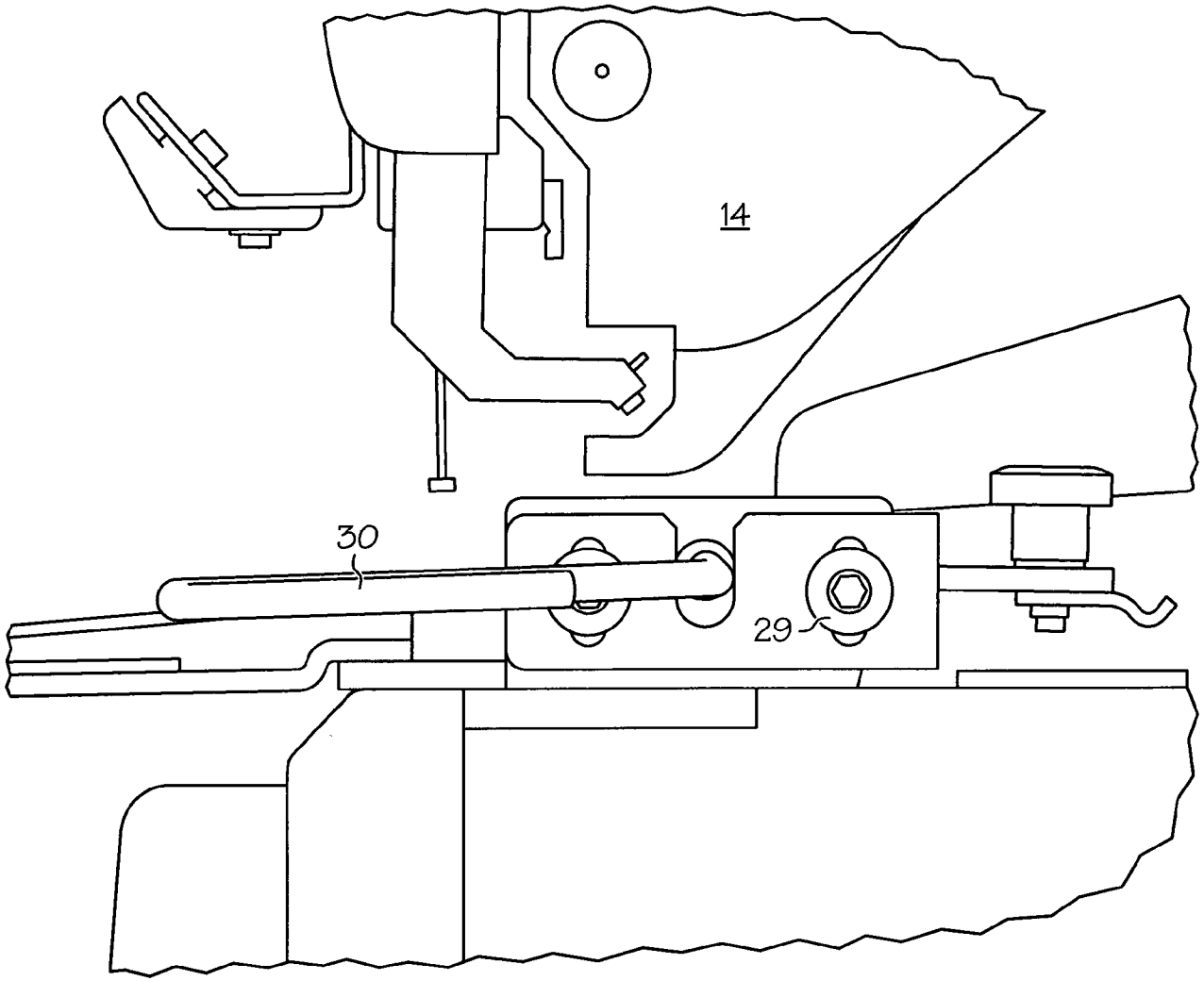
FIG. 11 is a perspective view of the embroidery machine illustrated in FIG. 1 showing the clamp positioned between the presser feet and the throat plate.
Figure 12:
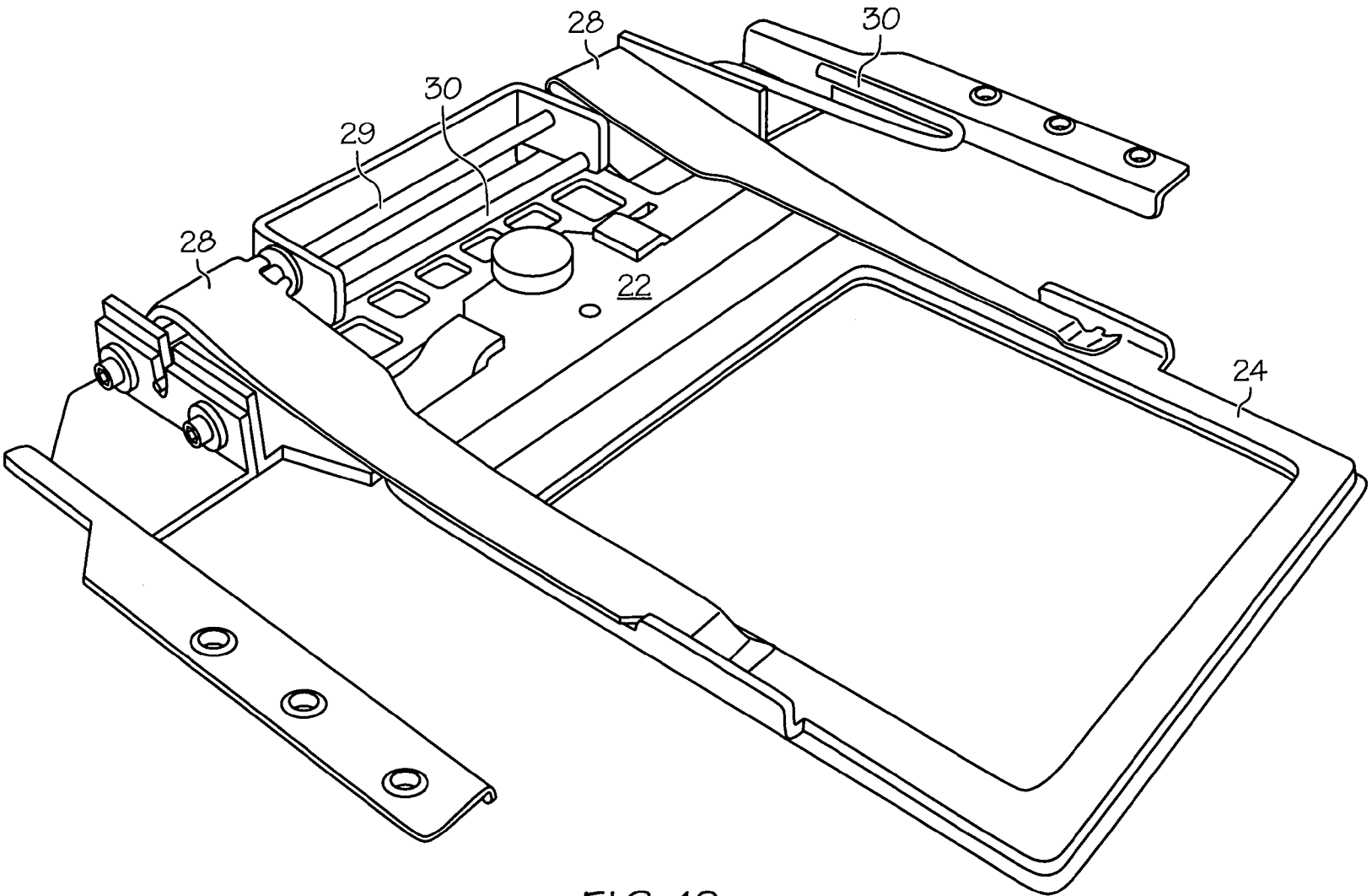
FIG. 12 is a perspective view showing the tubular arms attached to the clamp.

Among other advantages, the above-described configuration permits an extremely low profile clamp. More particularly, as illustrated in FIG. 11, this configuration permits it has a sufficiently low clamp profile that the clamp can be configured and dimensioned to pass in the vertical space between the presser feet (while in the retracted position) and the throat plate. Such a low profile is highly advantageous, as it significantly reduces serious damage to the embroidery machine. For example, when the clamp is attached to an X-Y drive bar 37 of a panagraph, no damage will be caused to the needles or presser feet if the panagraph cycles the clamp through its full X-Y movement while the clamp is secured to the paragraph. Such full X-Y movement occurs on many machines during machine initialization.

The foregoing descriptions of the exemplary embodiments of the invention have been presented for purposes of illustration and description only. They are not intended to be exhaustive or to limit the invention to the precise forms disclosed, and modifications and variations are possible and contemplated in light of the above teachings. While a number of exemplary and alternate embodiments, methods, systems, configurations, and potential applications have been described, it should be understood that many variations and alternatives could be utilized without departing from the scope of the invention. It should be reiterated that not all aspects of the invention need to be used in combination with all other aspects, and a variety of combinations of such aspects are possible.

Thus, it should be understood that the embodiments and examples have been chosen and described in order to best illustrate the principals of the invention and its practical applications to thereby enable one of ordinary skill in the art to best utilize the invention in various embodiments and with various modifications as are suited for particular uses contemplated. Accordingly, it is intended that the scope of the invention be defined by the claims appended hereto.

What is claimed is:

1. An embroidery machine, comprising:

(a) a base;

(b) a throat plate;

(c) a head extending outwardly from the base;

(d) a plurality of presser feet extending from the head toward the throat plate, each of the presser feet being movable relative to the head toward and away from the throat plate and being associated with a needle adapted to pass through an article to be embroidered, each of the presser feet being movable between a retracted position in which the presser feet are spaced from throat plate by a predetermined space and an extended position in which the presser feet are adapted to engage an article to be embroidered that is positioned in a sewing location between the presser feet and the throat plate;

(e) a first clamping window, the first clamping window having a first embroidery opening;

(f) a second clamping window having a second embroidery opening, the first and second damping windows being movable between first relative positions in which the second clamping window is spaced from the first clamping window and second relative positions in which the first and second openings are aligned with each other, the first and second clamping windows being cooperatively operative to clamp an article to be embroidered in the sewing location between the presser feet and the throat plate when the clamping windows are in their second relative positions;

(g) a clamp for effectuating relative movement between the first and second clamping windows and applying a compressive force between the first and second windows when the clamping windows are in their second relative positions for securing an article to be embroidered therebetween, the clamp including at least one clamp arm interconnecting with the clamping windows and an actuator for applying a bending stress to be at least one clamp arm;

(h) a panagraph, the clamp being secured to the panagraph, the panagraph being operative to effectuate two dimensional movement to the clamp and to move an article secured between the clamping windows relative to the needles in two-directional movement perpendicular to the predetermined space between the presser feet and the throat plate, the clamp, including the clamp arm and actuator, being dimensioned and configured to pass through the predetermined space between the presser feet and the throat plate so as to prevent damage if the panagraph positions the clamp in the space between the presser feet and the throat plate.

2. An embroidery machine as recited in claim 1 wherein the at least one arm is formed of resilient material and the clamp utilizes the resilient properties of the at least one arm to apply a compressive force between the clamping windows.

3. An embroidery machine as recited in claim 2 wherein the at least one arm is rotatably mounted on a first shaft.

4. An embroidery machine as recited in claim 3 further including at least one roller rotatably mounted on an actuating shaft extending parallel to the first rotatable shaft, the actuating shaft including a portion that is offset from the rotatable axis of the actuating shaft with the roller being rotatably mounted on the offset portion whereby rotation of the actuating shaft results in arcuate movement of the roller.

5. An embroidery machine as recited in claim 4 wherein the at least one arm extends around the first rotatable shaft with a relatively long window interface portion extending on one side the first rotatable shaft and interfacing with the clamping windows, and a relatively short return portion extending on the opposite side of the first rotatable shaft, and wherein the arcuate movement of the at least one roller applies a clamping force to the window interface portion by engaging and applying a bending stress against the return portion.

6. An embroidery machine as recited in claim 4 wherein the actuating shaft is movable between first and second positions, the first position corresponding to the first relative positions of the clamping windows and the second position corresponding to the second relative positions of the clamping windows.

7. An embroidery machine as recited in claim 6 further including a spring for urging the actuating shaft toward the first position.

8. An embroidery machine as recited in claim 7 further including an actuator handle for rotating the actuating shaft.

9. An embroidery machine as recited in claim 1 wherein the clamp further includes a pair of arms interconnecting with the clamping windows, the arms being mounted on a first shaft and being formed of material having sufficient resiliency so as to permit the arms to act as leaf springs, an actuator including an actuating shaft extending parallel to the first shaft including an offset portion onto which a pair of rollers are mounted whereby rotation of the actuating shaft results in arcuate movement of the roller, the actuating shaft being rotatably movable between first and second positions, the first position corresponding to the first relative positions of the clamping windows and the second position corresponding to the second relative positions of the clamping windows, each of the arms extending around the first shaft and including a relatively long window interface portion extending on one side the first shaft and interfacing with the clamping windows, and a relatively short return portion extending on the opposite side of the shaft, and wherein the arcuate movement of the rollers applies a clamping force to the interface portion of the arms by engaging the return portions and applying a bending stress against the return portions.

10. In combination with an embroidery machine having a base, a head extending outwardly from the base, the head having a plurality of needles extending therefrom, the needles being movable between a first retracted position and an extended position, a clamping mechanism for holding an article to be embroidered beneath the head, the clamping mechanism comprising:

first and second clamping frames having a first and second embroidery openings respectively, the first and second clamping frames being movable between first relative positions in which the clamping frames are separated and second relative positions in which the clamping frames compressingly engage an article to be embroidered therebetween, the clamping mechanism including an actuator for a relatively moving the first and second clamping frames and to selectively applying a compressive force upon an article positioned between the first and second clamping frames, the clamping mechanism, the clamping mechanism, including the actuator being dimensioned and configured to fit in the space between the retracted position of the needles and the throat plate.

11. A clamp for use in an embroidery machine, comprising:

(a) a base, (b) first and second embroidery clamping windows, the first clamping member being secured relative to the base;

(c) a shaft rotatably mounted on the base;

(d) a clamp arm formed of resilient material secured to the shaft, the clamp arm including a relatively long window interface portion extending in a direction generally toward the first clamping window from a first side of the rotatable shaft and a relatively short return portion extending in the same general direction from the opposite side of the rotatable shaft, the window interface portion of the clamp arm being connectable to the second embroidery clamping window; and (e) an actuator for pivotally rotating the clamp arm with respect to the base, the actuator including a roller for applying a force against the return portion of the clamp arm and utilizing the resilient properties of the clamp arm to transfer the force applied by the roller to the window interface portion of the clamp arm so as to move the second embroidery clamping window relative to the first clamping window and to selectively apply a force against the window interface portion of the clamp arm to urge the second clamping window into compressing relationship to the first clamping window for compressingly holding an article to be embroidered between the first and second windows.

12. A clamp as recited in claim 11 wherein the clamp arm is formed of spring tempered stainless steel.

13. A clamp as recited in claim 11 wherein the clamp is dimensioned and configured to pass through a space between the presser feet and a throat plate on an embroidery machine so as to prevent damage to the embroidery machine if the clamp is positioned between the presser feet and the throat plate of an embroidery machine.

14. An embroidery machine, comprising:

(a) a base;

(b) a throat plate;

(c) a head extending outwardly from the base;

(d) a plurality of presser feet extending from the head toward the throat plate, each of the presser feet being movable relative to the head toward and away from the throat plate and being associated with a needle adapted to pass through an article to be embroidered, each of the presser feet being movable between a retracted position in which the presser feet are spaced from throat plate by a predetermined space from the throat plate and an extended position in which the presser feet are adapted to engage an article to be embroidered that is positioned in a sewing location between the presser feet and the throat plate while the needles pass through the article to be embroidered;

(e) a first clamping window, the first clamping window having a first embroidery opening;

(f) a second clamping window having a second embroidery opening, the first and second damping windows being movable between first relative positions in which the second clamping window is spaced from the first clamping window and second relative positions in which the first and second openings are aligned with each other, the first and second clamping windows being cooperatively operative to clamp an article to be embroidered in the sewing location between the presser feet and the throat plate when the clamping windows are in their second relative positions;

(g) a clamp including at least one arm rotatably mounted on a first shaft and interconnecting with the clamping windows for effectuating relative movement between the first and second clamping windows and applying a compressive force between the first and second windows when the clamping windows are in their second relative positions for securing an article to be embroidered therebetween, the clamp further including an actuator with at least one roller that is moved along a portion of the at least one arm to apply a bending moment on the arm and to apply a compressive force between the clamping windows, the clamp being formed of resilient material and being operative to utilize the resilient properties to apply a compressive force between the clamping windows;

(h) a panagraph, the clamp being secured to the panagraph, the panagraph being operative to effectuate two dimensional movement to the clamp and to move an article secured between the clamping windows relative to the needles in two-directional movement perpendicular to the predetermined space between the presser feet and the throat plate, the clamp being dimensioned and configured to pass through the predetermined space between the presser feet and the throat plate so as to prevent damage if the panagraph positions the clamp in the space between the plates and the throat plate.

* * * * *